US006719383B2

(12) United States Patent
Elick et al.

(10) Patent No.: US 6,719,383 B2
(45) Date of Patent: Apr. 13, 2004

(54) RETRACTABLE APPLIANCE CONTROL

(75) Inventors: Robert A. Elick, Jackson, TN (US); Barry E. Tuller, Humboldt, TN (US); Scott D. Raches, Jackson, TN (US); Rodney M. Welch, Jackson, TN (US); Neeraj Singh, Shreveport, LA (US); Anthony L. Durfee, Jackson, TN (US)

(73) Assignee: Maytag Corporation, Newton, IA (US)

( * ) Notice: Subject to any disclaimer, the term of this patent is extended or adjusted under 35 U.S.C. 154(b) by 78 days.

(21) Appl. No.: 10/044,176

(22) Filed: Jan. 10, 2002

(65) Prior Publication Data

US 2003/0127954 A1 Jul. 10, 2003

(51) Int. Cl.[7] ..... A47B 77/00
(52) U.S. Cl. ..... 312/228
(58) Field of Search ..... 312/228, 228.1, 312/319.1, 319.5, 319.8; 134/113, 201

(56) References Cited

U.S. PATENT DOCUMENTS

| | | | | |
|---|---|---|---|---|
| 2,364,604 A | * | 12/1944 | Creager | 312/272 |
| 3,983,553 A | | 9/1976 | Kesling | 340/365 |
| 4,703,306 A | | 10/1987 | Barritt | 340/310 |
| 5,365,959 A | * | 11/1994 | Favaro | 134/113 |
| 5,404,895 A | * | 4/1995 | Yamauchi et al. | 134/201 |
| 5,551,461 A | | 9/1996 | St. Martin | 134/111 |
| 5,862,468 A | * | 1/1999 | Kim | 455/321 |
| 6,295,004 B1 | * | 9/2001 | Burnett | 340/686.1 |

FOREIGN PATENT DOCUMENTS

| | | | |
|---|---|---|---|
| FR | 2657224 | * | 7/1991 |

* cited by examiner

*Primary Examiner*—James O. Hansen
(74) *Attorney, Agent, or Firm*—McKee, Voorhees & Sease, P.L.C.

(57) ABSTRACT

A control panel is retractably received within a recess in an appliance housing. The panel may be moved from an extended position wherein the control panel is exposed outside the cabinet to a retracted position wherein the control panel is enclosed within the recess. A spring urges the control panel to its extended position, and a latch is provided for releasably holding the control panel in its retracted position.

23 Claims, 9 Drawing Sheets

RETRACTABLE APPLIANCE CONTROL

BACKGROUND OF THE INVENTION

The present invention relates to a retractable appliance control and method for using same. The preferred use for the invention is in a dishwasher, but the invention may be utilized in other appliances as well.

Disadvantage of prior control panels is that they are often contained within the door itself. The wires lead from the door to the other systems within the dishwasher. It is undesirable to route wires through a dishwasher door because the repeated flexing of wires at each opening and closing of the door results in wire fatigue and damage.

Another difficulty with prior art control panels is that they are located at the upper edge of the door and are usually vertically oriented. They are often positioned below the countertop and are difficult to view. Attempts to improve viewing of the controls have been made by angling the control panel surface, but this is limited due to space availability and also due to the shading or blocking created by the countertop overhang.

Another disadvantage of prior art control panels is that they are exposed at all times, and can be damaged by spills or dropped articles from the countertop.

Therefore, a primary object of the present invention is the provision of a retractable appliance control and method for using same.

A further object of the present invention is the provision of an appliance control which can be retracted when not in use, and which can be extended outwardly for use when desired.

A further object of the present invention is the provision of a retractable appliance control that presents its controls in an upward direction that can be easily viewed by the operator.

Another object of the present invention is the provision of a retractable appliance control that can be mounted either to the countertop or to the main cabinet of the appliance so that the control does not move with the door and wires do not need to be routed within the door.

A further object of the present invention is the provision of a retractable appliance control that minimizes the space used within the door.

A further object of the present invention is the provision of a control that can be mounted external to the door so that it can be located in the highest vertical position.

SUMMARY OF THE INVENTION

The foregoing objects may be achieved by an appliance control system which comprises in combination a control mounting frame having a control receiving recess therein. An electrical power system or interface is provided within the appliance for powering the functions of the appliance. The control system may be remote from the appliance or part of it. For example the control system could be retractably mounted below a cupboard.

The appliance control system includes a control panel having a panel housing and a plurality of control members on the exterior surface of the panel. At least one electrical connector connects the control members to the electrical power system for controlling the appliance. A bracket assembly mounts the control panel within the control receiving recess for movement from a recessed position wherein the control members are substantially contained within the control receiving recess to an extended position wherein the control members are outside the control receiving recess.

While the preferred appliance for this control system is a dishwasher, the control system may also be used in other appliances.

According to another feature of the invention the combination includes a countertop having front and rear edges, the cabinet being mounted below the countertop and having an upstanding front cabinet panel and a remaining cabinet housing. The front cabinet panel is positioned below the front edge of the countertop and the control receiving recess extends into the upstanding front panel.

According to a further feature of the invention the front cabinet panel is a door hinged for movement between an open and a closed position. The recess extends through the door into the remaining cabinet housing, and the bracket assembly connects the control panel to the remaining cabinet housing so that the control panel does not move with the door when the door moves between its open and closed positions.

According to another feature of the present invention a latch mechanism retentively engages the control panel and holds the control panel within the recess. A spring yieldably urges the control panel from the recessed position to the extended position. The latch mechanism is releasable to permit the control panel to move from the recessed to the extended position.

According to a further feature of the present invention a damping assembly is connected to the cabinet and to the control panel for resisting movement of the control panel from its recessed position to its extended position and from its extended position to its recessed position.

According to a further feature of the invention the damping assembly comprises a first damping member mounted to the cabinet for movement with respect thereto and a second damping member frictionally engaging the first damping member and the cabinet. The first damping member is movable in response to movement of the control panel between the recessed and extended positions.

According to a further feature of the invention a grease material is located between the first and second damping members and between the second damping member and the cabinet.

The damping mechanism can take several forms. One embodiment utilizes a circular disc which rotates, but provides a damping resistance to extension and retraction of the control panel. Another embodiment utilizes a rotatable gear engaging an elongated rack to provide the damping force. Other types of damping mechanisms may be used.

According to the method of the present invention the control panel is stored within a recess in, or separate from, the appliance cabinet. The control panel is then moved at least partially outside the recess so that the control members are exposed for manipulation to control the power system. After manipulation of the control members, the control panel can be moved back within the recess in the appliance cabinet.

DETAILED DESCRIPTION OF THE PREFERRED EMBODIMENT

Figure 1:
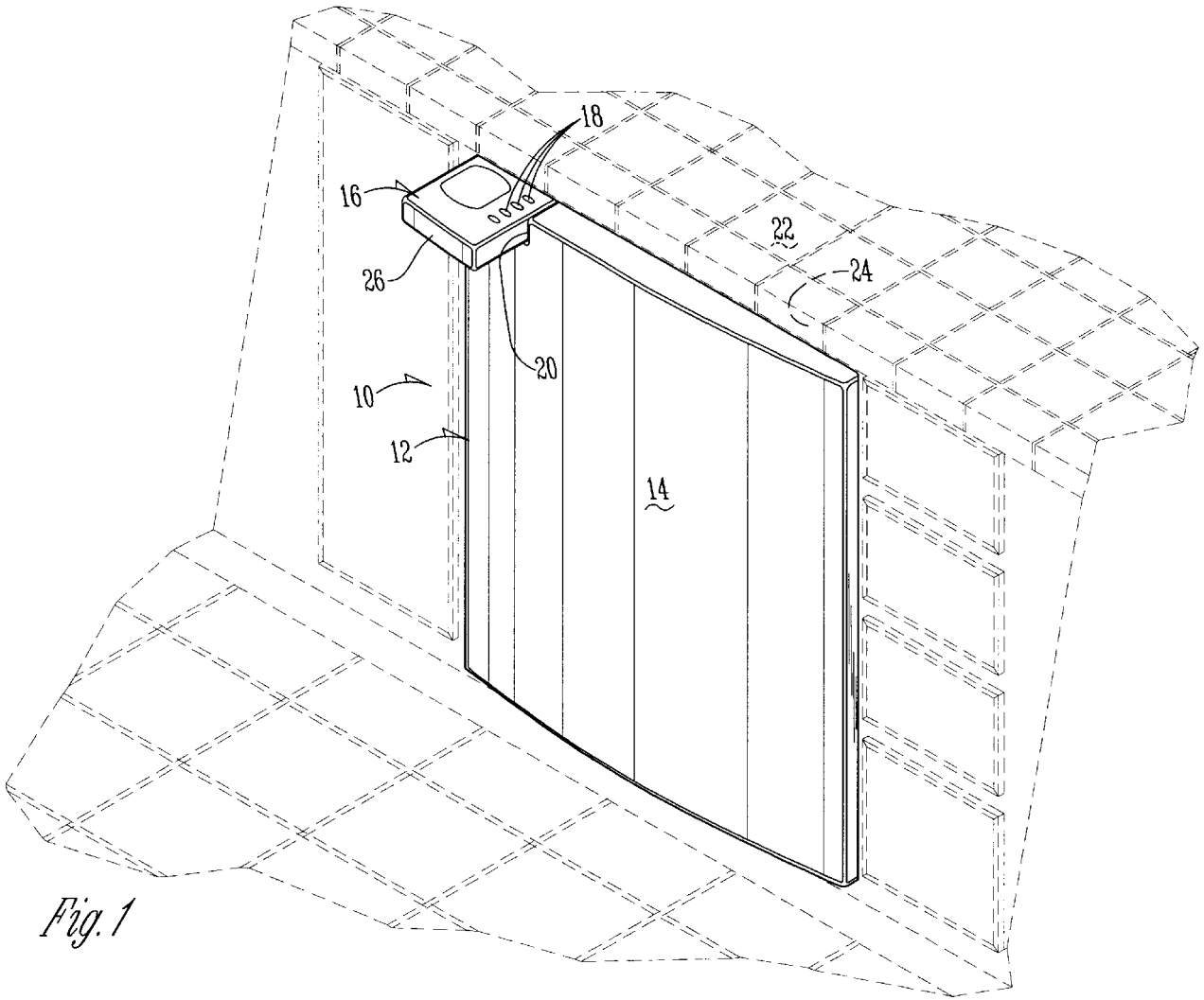
FIG. 1 is a pictorial view of a dishwasher mounted beneath a cabinet and employing the retractable appliance control of the present invention.
Figure 3:
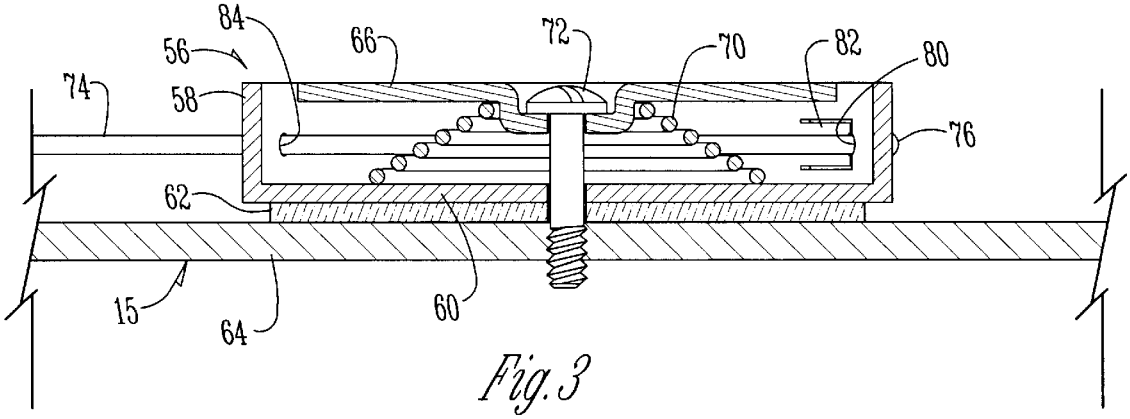
FIG. 3 is a sectional view taken along line 3—3 of FIG. 4.

Referring to FIG. 1, the numeral 10 generally designates a dishwasher. Dishwasher 10 includes a cabinet 12 having a front door 14 which is mounted at the front of a stationary cabinet housing 15 (FIG. 3).

A slide out control panel 16 includes a plurality of control buttons 18 on the upper surface thereof, and is mounted for sliding movement into and out of recess 20. In its retracted position the front edge 26 of control panel 16 is preferably flush with the front face of door 14. The control panel 16 is shown in its extended position in FIG. 1.

A countertop 22 includes a front edge 24 which is positioned above and adjacent the upper edge of the door 14.

Figure 2:
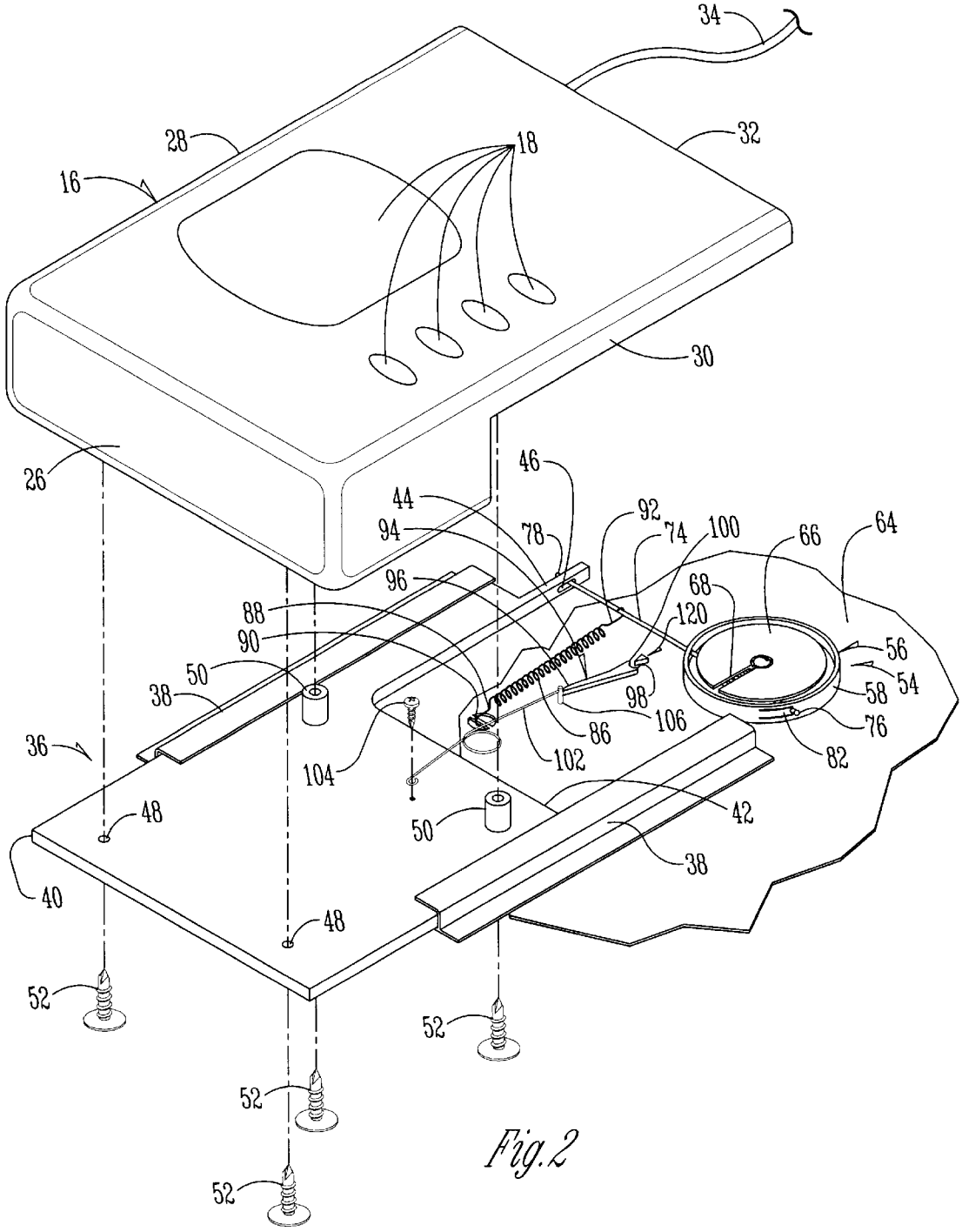
FIG. 2 is an exploded perspective view of the retractable control panel of the present invention.

Referring to FIG. 2, the slide out control panel 16, in addition to front panel edge 26 includes opposite side panel edges 28, 30 and a rear panel edge 32. Extending from the rear edge 32 is a control cable 34.

Control panel 16 is attached to a bracket assembly 36. Bracket assembly 36 includes a spaced apart pair of side tracks 38 which are fixed to a base plate 64. Base plate 64 may be part of the cabinet 15, or it may be a separate plate which is attached to the counter top 22, or any other part of the counter. Bracket assembly 36 could also be one centrally mounted slide with Z side guides for stiffening.

Mounted for sliding movement within the spaced apart tracks 38 is a slide plate 40 having a corner cut out 42 forming an extended leg 44. An oval aperture 46 extends through the leg 44.

Panel 16 is attached to the slide plate 40 by means of screws 52 which extend upwardly through front screw holes 48 and rear screw posts 50.

A damping assembly 54 includes a dish shaped disc 56 having an annular side wall 58 and a flat bottom wall 60 (see FIG. 3). A grease retainer 62 is mounted between the bottom wall 60 of disc 56 and the base plate 64. A top plate 66 is positioned above the disc 56 and includes a radially extending top plate slot 68. Beneath top plate 66 is a cone shaped spring 70. A bolt 72 extends through top plate 66 and the bottom wall 60 of disc 56, as well as the grease retainer 62. The bolt 72 is threaded into base plate 64, but there is a slight clearance between bolt 72 and the grease retainer 62, the bottom wall 60 of disc 56, and the top plate 66 so as to permit them to rotate relative to bolt 72. The pressure that disc 56 applies to grease retainer 62 can be adjusted by rotating the bolt 72, and this pressure is transferred to the disc 56 by means of the cone shaped spring 70.

The grease retainer 62 is preferably made of a fabric which can be impregnated with grease so that grease engages both the bottom wall 60 of disc 56 and the upper surface of plate 64. The grease, in combination with the pressure between disc 56 and grease retainer 62 causes the disc 56 to yieldably resist rotation.

An elongated rod 74 includes a beaded end 76 and an unbeaded end 78. Rod 74 extends through a first aperture 80 (FIG. 3) which has a spring finger 82 that engages the beaded end 76 of rod 74. Rod 74 extends through a second aperture 84 in the annular wall 58 of disc 56, and then through the oval aperture 46 in the extended leg 44. The aperture 46 has an oval shape so that leg 44 can move from the position shown in FIG. 4 to the position shown in FIG. 5 without any binding occurring between the rod 74 and the aperture 46.

A spring 86 has an anchor end 88 which is anchored to the base plate 64 by means of a screw 90. Spring 86 includes a rod end 92 which is attached to the rod 74. The spring 86 is in tension so that it yieldably urges the rod 74 and the disc 54 to the left as viewed in FIG. 2. This exerts a yieldable force on the slide plate 40 toward its extended position. FIG. 2 shows the slide plate 40 in a partially extended position, but the spring 86 is adapted to move the slide plate 40 to its fully extended position. In the extended position the control buttons 18 are exposed vertically upwardly and can be easily seen and manipulated by the operator.

A latch member 94 is Y-shaped and is fixed to the upper surface of the base plate 64. Latch member 94 includes a leg 96 and first and second Y-arms 98, 100. Positioned within the Y formed by legs 98, 100 is a triangular member 120 having a first cam surface 122 spaced a short distance from leg 98 and a second cam surface 124 spaced a short distance from leg 100.

A latch spring 102 has one end fixed to the slide plate 40 by means of an anchor screw 104. The opposite end of spring 102 includes a pawl 106. Two protrusions 126, 127 engage the opposite sides of latch spring 102 to hold it in place.

Figure 6B:
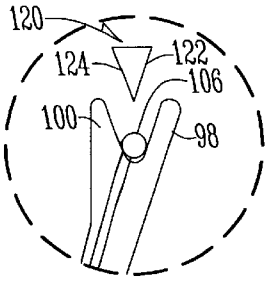
FIG. 6B is an enlarged view taken along line 6B—6B of FIG. 6A.
Figure 6A:
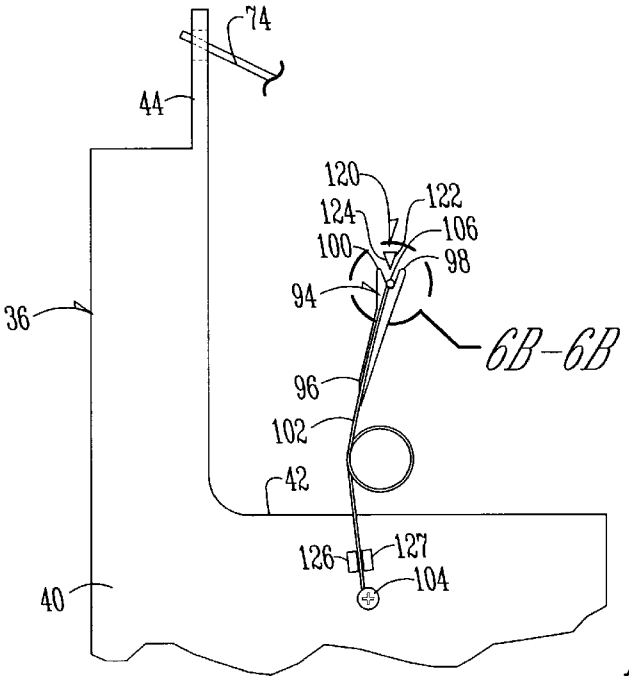
FIG. 6A is a view similar to FIG. 6, but showing the latching mechanism in its latched position.
Figure 6:
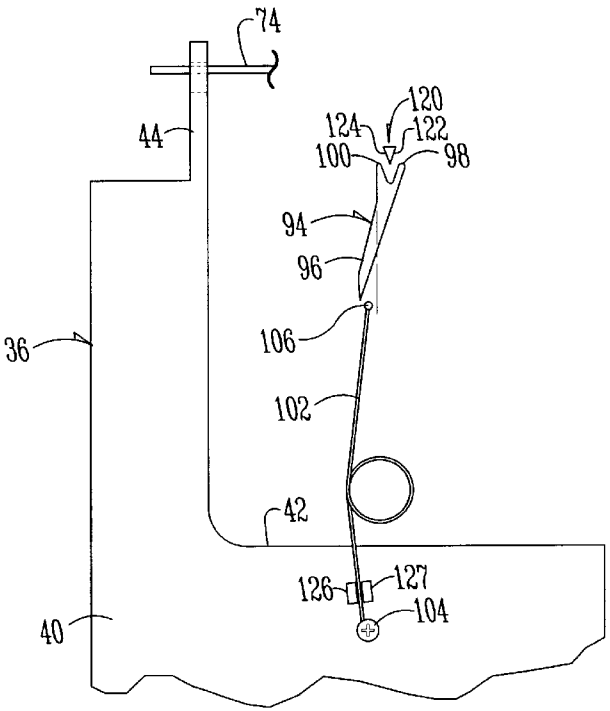
FIG. 6 is a partial top plan view of the latching mechanism for the present invention.

The latch spring 102 is shown disengaged from the latch member 94 in FIG. 2. FIG. 6 illustrates the relative positions of the latch member 94 and the spring 102. As the slide plate 40 is pushed inwardly into the recess 20, the pawl 106 cams against the right-hand surface of the Y-leg 96. Upon reaching the upper end of leg 98 the pawl 106 springs to the left and engages surface 122 of triangular member 120. The pawl 106 then moves to the fork of the legs 98, 100 while the slide 40 is at rest in its retracted position. FIG. 6A shows the slide plate 42 in its fully retracted position with the pawl 106 embraced between the two Y-legs 98, 100. In this position the spring 102 is exerting a slight force to the left as viewed in FIG. 6A.

When it is desired to move the control panel 16 to its extended position the control panel 16 is pushed inwardly and this permits the pawl 106 to spring to the left as viewed in FIG. 6A so that it rides around arm 100. The spring 86 then causes the slide plate 42 to move to its extended position, and the pawl 106 cams along the left-hand surface of latch member 94. When the pawl 106 moves out of engagement with the lower end of Y-leg 96, it springs back to its original position shown in FIG. 6.

Figure 4:
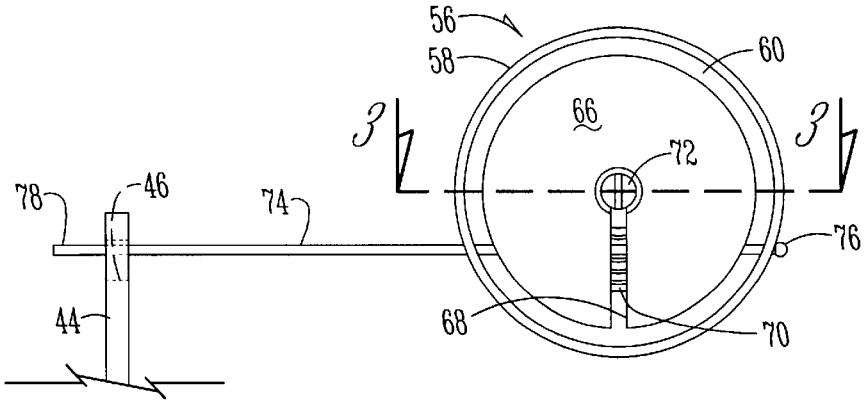
FIG. 4 is a top plan view of the damping mechanism shown in FIG. 3.
Figure 5:
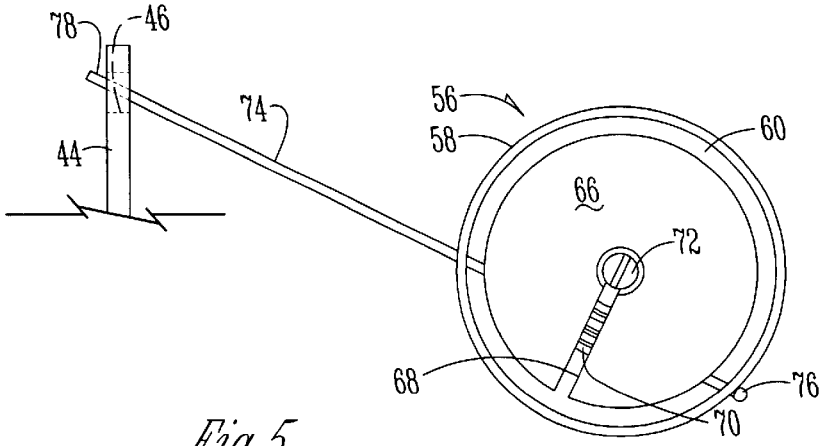
FIG. 5 is a view similar to FIG. 4, but showing the damping mechanism in a different position.

The damping assembly 54 provides a resistance to the sliding movement of slide plate 40 both from its retracted position to its extended position and also from its extended position to its retracted position. Referring to FIG. 4, the position of the damping mechanism is shown with the slide plate 40 in its fully extended position. FIG. 5 illustrates the position of the damping assembly 54 when the slide plate 40 is in its fully retracted position. As can be seen by comparison of FIGS. 4 and 5, the disc 56 rotates from the position shown in FIG. 4 to the position shown in FIG. 5. This movement is resisted by the frictional engagement between the disc 56 and the base plate 64. The grease retainer 62 lubricates the movement between these two components, but the pressure between the two causes a damping action upon the extension and retraction of the slide plate 40.

Figure 8:
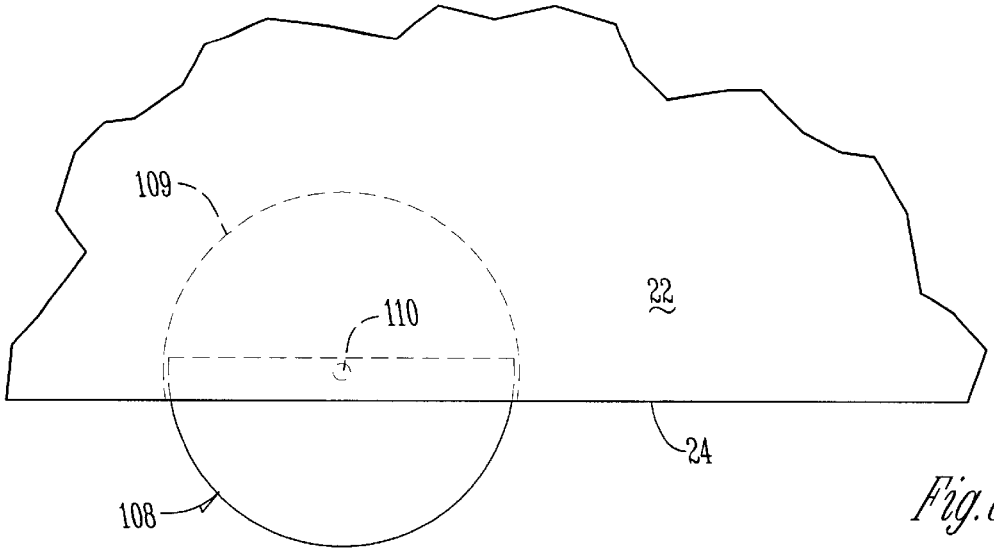
FIG. 8 is a plan view of a modified form of the present invention.
Figure 8A:
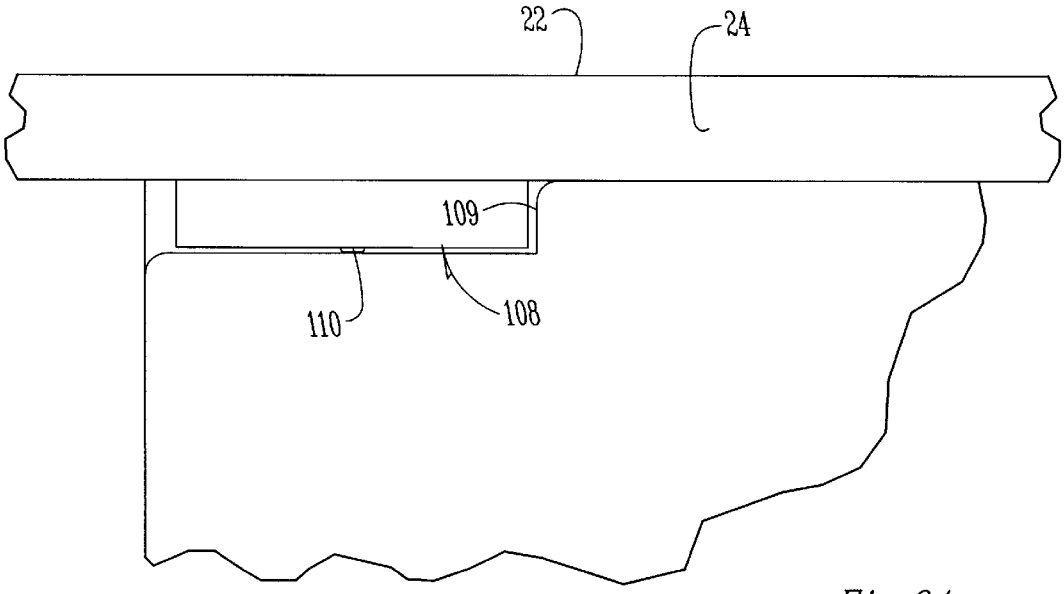
FIG. 8A is a front elevational view of the modification shown in FIG. 8.
Figure 9:
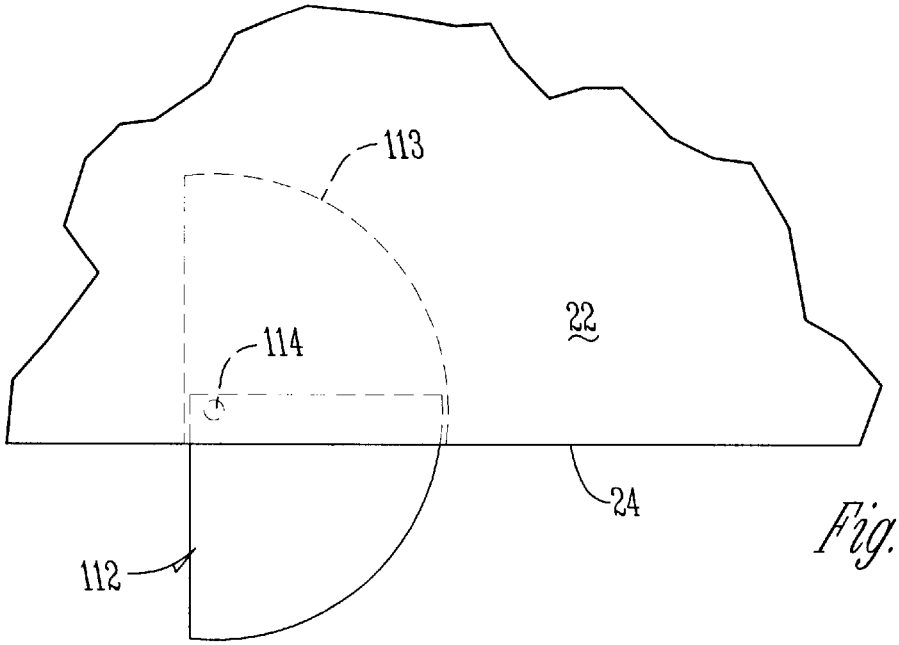
FIG. 9 is a top plan view of another modified form of the present invention.

FIGS. 8 and 9 show modified forms of the present invention. A semicircular control panel 108 is adapted to pivot into a semicircular recess 109 about a pivot axis 110. Conventional latching mechanisms and springs are well known in the art for controlling the movement of the control panel 108 between these two positions.

Figure 9A:
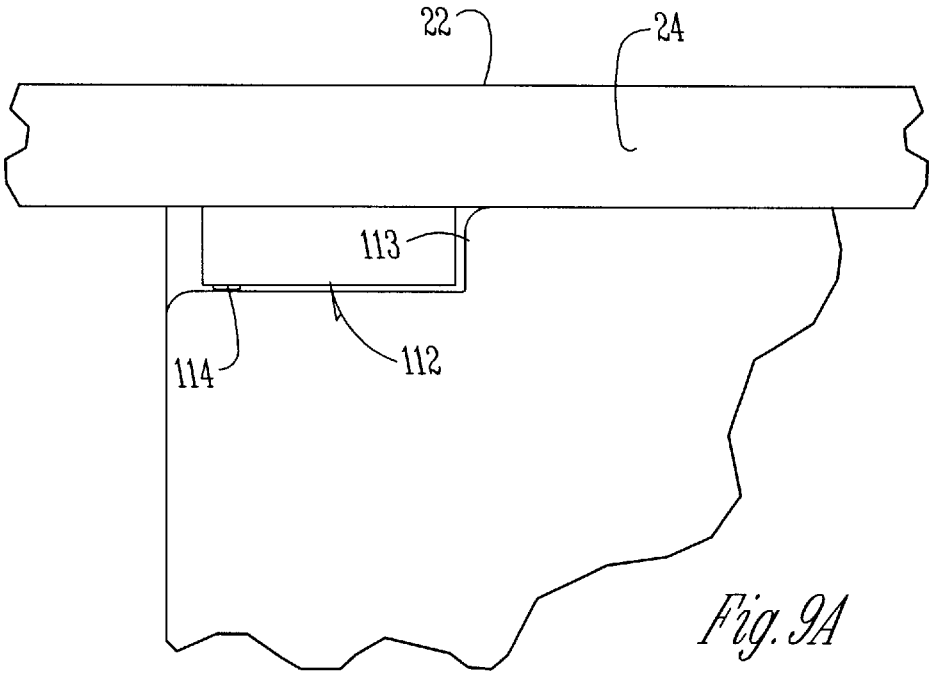
FIG. 9A is a front elevational view of the modification shown in FIG. 9.
Figure 10:
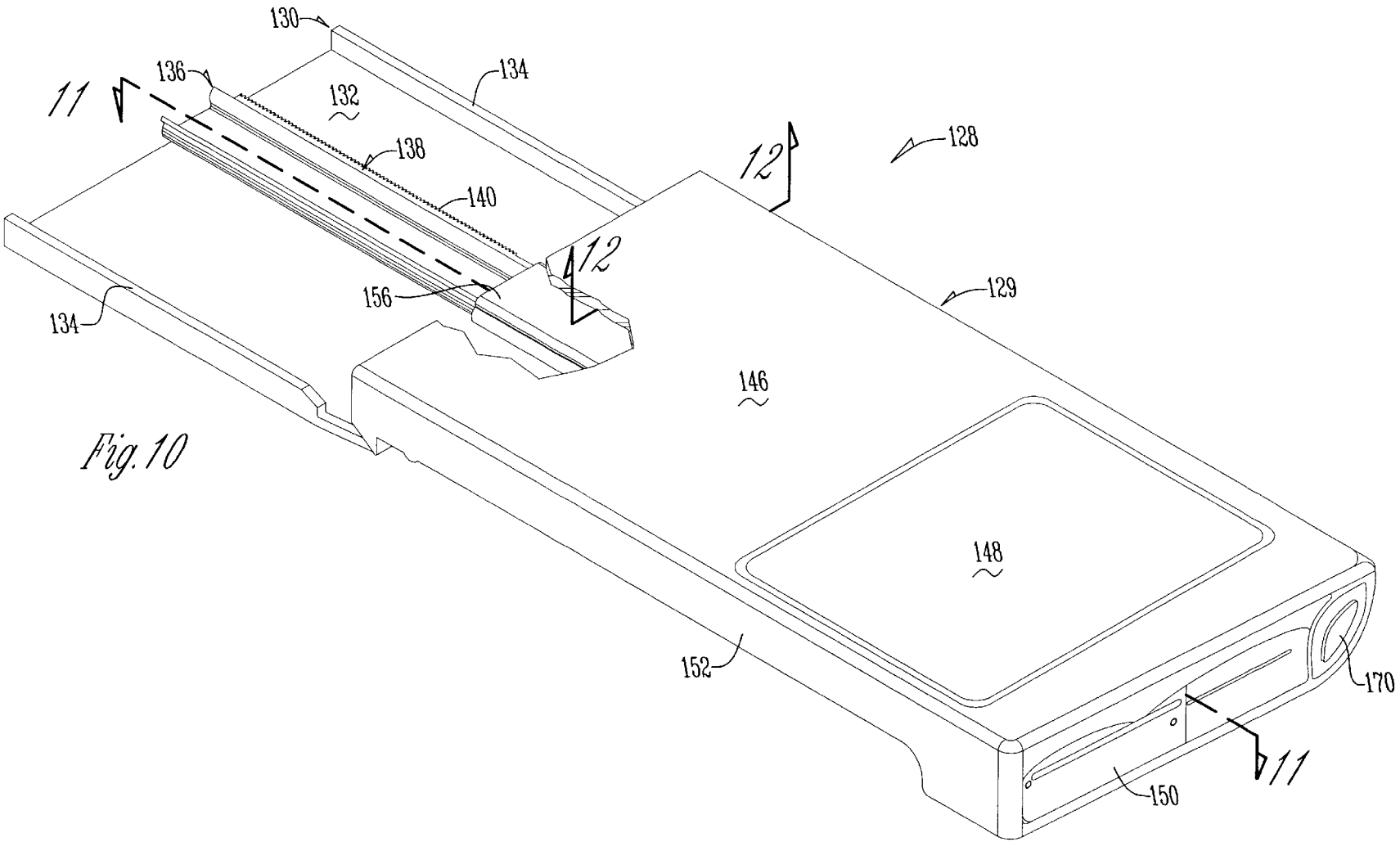
FIG. 10 is a perspective view of a modified form of the invention.
Figure 11:
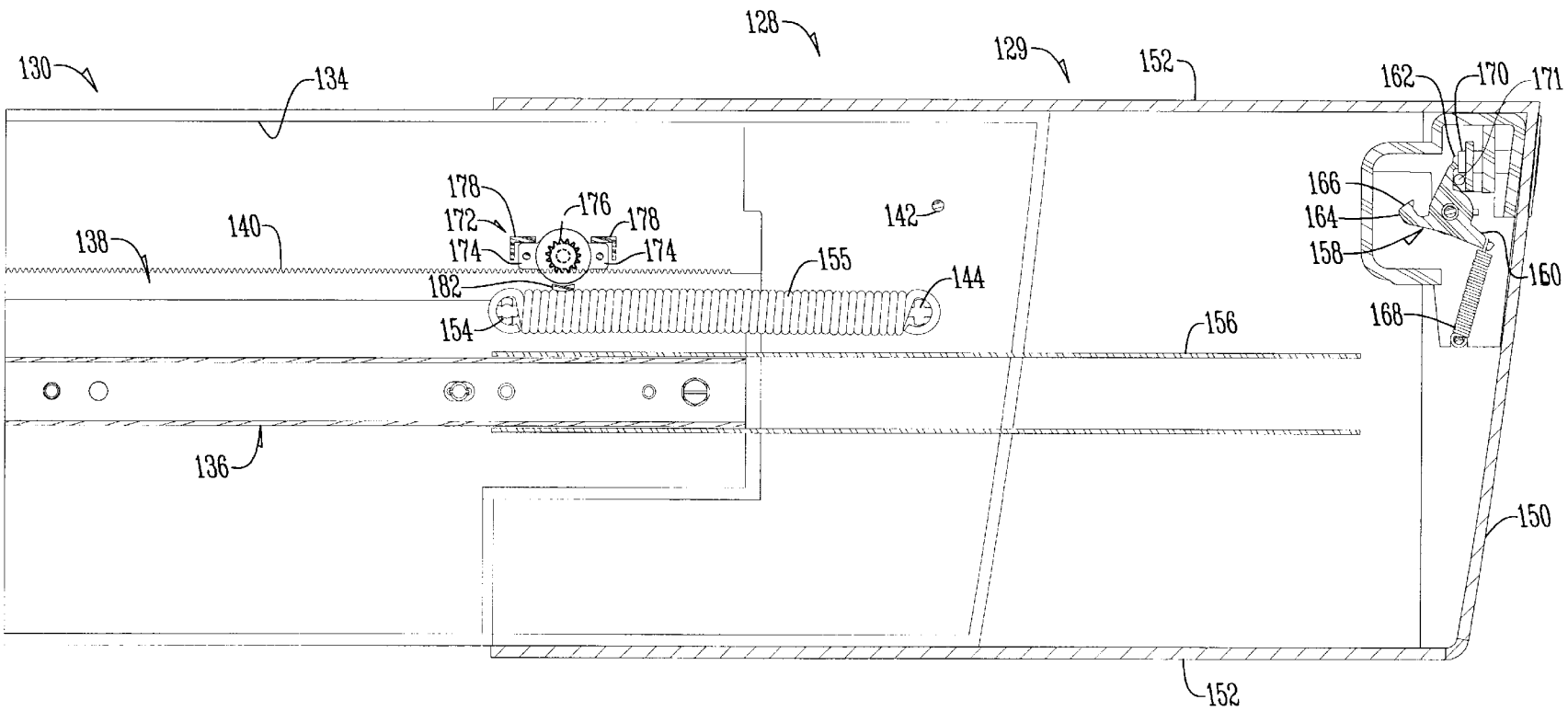
FIG. 11 is a sectional view taken along line 11—11 of FIG. 10.

FIGS. 9 and 9A show a similar arrangement for a quarter circle panel 112 which fits within a quarter circle recess 113 and which pivots about a pivotal axis 114.

Figure 7:
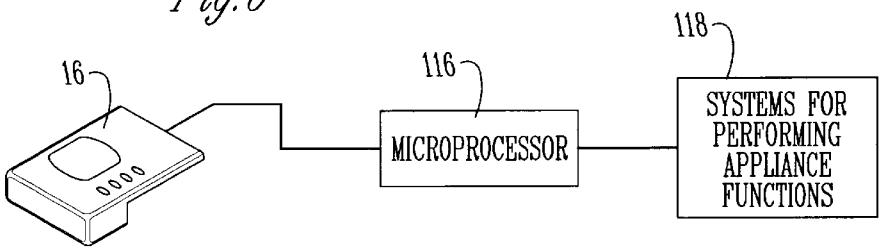
FIG. 7 is a schematic view showing the relationship of the control panels to the systems for performing the appliance functions.

Referring to FIG. 7, the control panel 16 is shown to be electrically connected to a microprocessor 116 which controls the various functions of the appliance systems as designated schematically in block 118.

Referring to FIGS. 10–12A a modified form of the control assembly is indicated by the numeral 128. Control assembly 128 includes a control panel 129 which is movable from an extended to a retracted position. It is mounted for sliding movement with respect to a bottom panel or frame 130. Bottom panel or frame 130 is comprised of a bottom plate 132 having side rails 134 and having mounted therein a U-shaped slide track 136. Also attached to bottom panel or frame 130 is an elongated rack 138 having gear teeth 140 extending along one side thereof. A latch pin 142 (FIG. 11) is attached to the panel or frame 130 and extends upwardly therefrom. Attached to and extending upwardly from the front edge of the bottom plate 130 is a spring post 144.

Control panel 129 includes an upwardly presented surface 146 having controls designated schematically by the numeral 148, a front edge 150, and side edges 152 adjacent the side rails 134 of bottom plate 132 for sliding movement with respect thereto. Attached to, and extending downwardly from the upper surface 146 is a spring post 154. A spring 155 is attached at one end to the downwardly extending spring post 154 of control panel 129 and is connected at the other end to the upwardly extending spring post 144 of bottom panel or frame 130. This spring biases the control panel 129 to its extended position shown in FIG. 11. In its retracted position with the rear edge 150 coinciding with the rear edge of the bottom panel 130, the spring 155 is in tension and yieldably urges the control panel 129 toward its extended position. The sliding movement of control panel 129 with respect to bottom panel 130 is facilitated by a U-shaped slide track 156 attached to the panel assembly 129 and retentively slidingly engaging the U-shape slide track 136 of the bottom panel 130.

A latching mechanism is provided for latching the control panel 129 in its retracted position, and includes a rotatable latch tumbler 158 having a spring arm 160, a button arm 162 and a latch pawl 164. Pawl 164 includes a cam surface 166. A spring 168 is connected to the spring arm 160 and is also connected to the control panel 129 so as to yieldably urge the latch tumbler 158 in a clockwise direction as viewed in FIG. 11. A manually operable button 170 engages the button arm 162 of latch tumbler 158, with a stop 171 in the housing limiting the rotational movement of latch tumbler 158 in a clockwise direction.

When the control panel 129 is moved to its retracted position, the cam surface 166 of latch pawl 164 engages the upstanding latch pin 142 of bottom panel 130 and causes the latch tumbler to cam in a counterclockwise direction against the bias of spring 168. This permits the pawl arm 164 to move around the latch pin 142 and then spring in a clockwise direction to latch and retentively engage the latch pin 142.

When it is desired to extend the control panel to its extended position the button 170 is pushed inwardly thereby releasing the pawl arm 164 from the latch pin 142 and permitting the control panel 129 to slide to its extended position in response to the bias provided by spring 155.

The numeral 172 refers to a damping device mounted to the bottom of top 146 and extending downwardly therefrom to engage the elongated rack 138. The damping device 172 includes a gear mounting member 173 having a pair of oppositely extending wings 174 and a circular central portion 175. Rotatably mounted to the central portion 175 is a rotating gear 176 which meshes with the gear teeth 140 of elongated rack 138.

Gear mounting member 173 is mounted for limited floating movement within a pocket formed by a pair of opposite end holders 178 and a pair of side holders 180, 182. The holders 178 each have an internal wall 179, and the holder 180 includes a pair of driving bosses 183. The damping device 172 is a product which is available from Ace Controls Inc. having an address of 23435 Industrial Park Drive, Farmington, Mich. 48335, under the Series No. G2.

Figure 12:
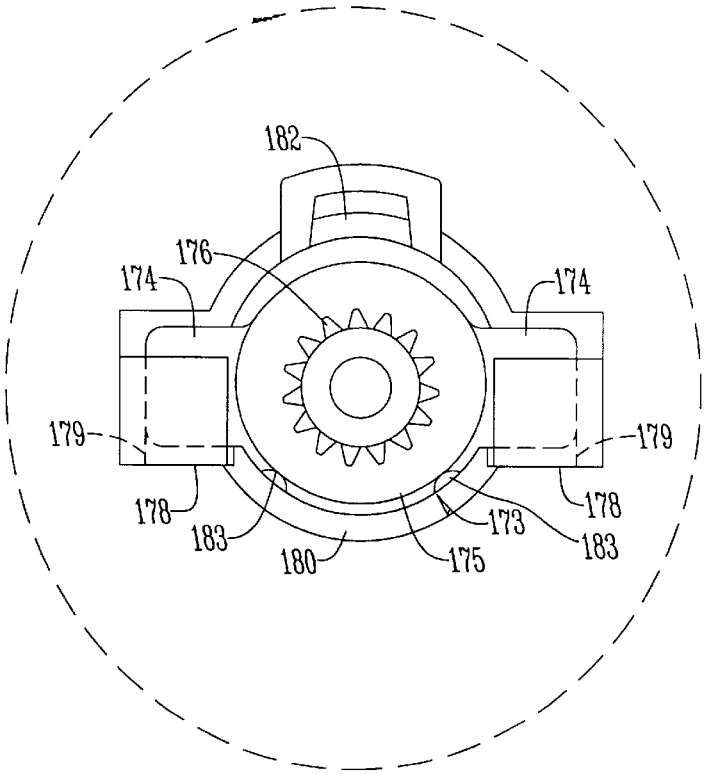
FIG. 12 is an enlarged view of the damping assembly taken along line 12—12 of FIG. 10.
Figure 12A:
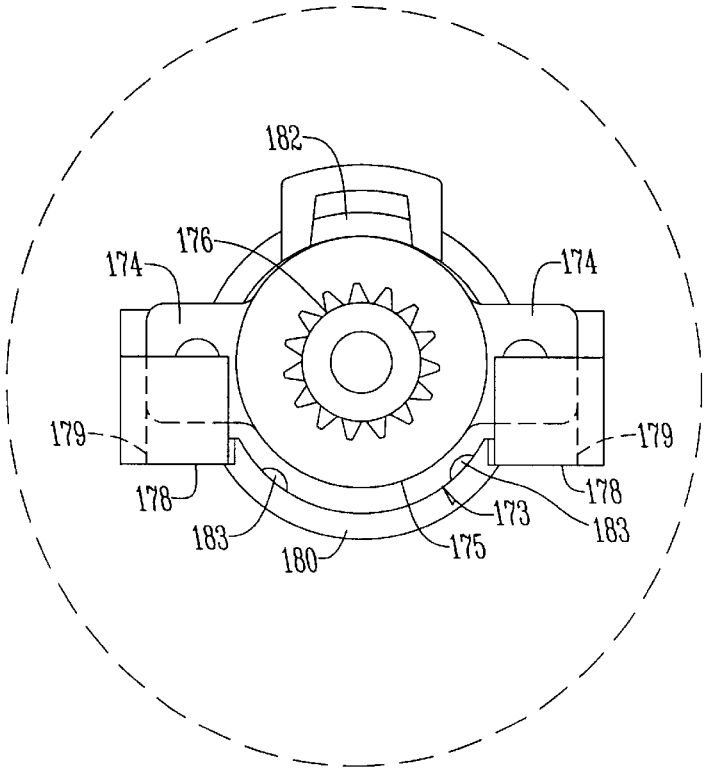
FIG. 12A is a view similar to FIG. 12, but showing the gear in a different position.

FIGS. 12 and 12A illustrate the limited floating movement of the gear mounting member 173 within the pocket formed by end holders 178, and side holders 180, 182. FIG. 12 shows the gear mounting member in a first position and FIG. 12A shows it in a second position. In FIG. 12 the central portion 175 of gear mounting member engages the side holder 180. In FIG. 12A the central portion 175 engages the opposite side holder 182. The floating movement of this gear mounting member permits the gear mounting member to take up tolerances within the assembly. The movement of the central portion from the position in FIG. 12 to the position shown in FIG. 12A is approximately 0.04 inches.

This permits the floating of the gear 176 so as to maintain the pitch circle of the gear 176 tangent to the pitch line of teeth 140 on rack 138 during both the retraction and the extension of the control panel 129.

The gear 176 has a limited amount of friction which imparts a damping action to the retraction and extension of the control panel 129. This imparts a smooth continuous movement of the control panel during its extension and retraction.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A retractable appliance control comprising in combination:

an appliance comprising a dishwasher having a control receiving recess therein;

an appliance system for performing a plurality of functions in said appliance;

a control panel having a panel housing and a plurality of control members on the exterior surface of said panel housing, at least one electrical connector connecting said control members to said appliance system for controlling said appliance system; and a bracket assembly mounting said control panel within said control receiving recess for movement from a retracted position wherein said control members are substantially contained within said control receiving recess to an extended position wherein said control members are outside said control receiving recess.

2. A retractable appliance control according to claim 1 and further comprising a countertop having front and rear edges, said panel housing being mounted below said countertop, said dishwasher having a cabinet, a door panel and a remaining cabinet housing, said door panel being positioned below said front edge of said countertop, said control receiving recess extending into said door panel.

3. A retractable appliance control according to claim 2 wherein said door panel includes a top edge, opposite side edges, and a bottom edge, said recess being located adjacent said top edge of said door panel.

4. A retractable appliance control according to claim 3 wherein said door panel comprises a door hinged to said cabinet for movement between open and closed positions, said recess extending through said door panel and into the remaining cabinet housing, said bracket assembly connecting said control panel to said remaining cabinet housing so that said control panel does not move with said door.

5. A retractable appliance control according to claim 1 wherein said bracket assembly mounts said control panel to said dishwasher for pivotal movement about a control panel axis during movement between said retracted and extended positions.

6. A retractable appliance control according to claim 5 wherein said control panel is in the shape of a semicircle.

7. A retractable appliance control according to claim 5 wherein said control panel is in the shape of a quarter circle.

8. A retractable appliance control comprising in combination:

an appliance having a cabinet housing;

an appliance system within said cabinet housing for performing a plurality of functions in said cabinet housing;

a control panel having a plurality of control members for controlling said appliance system;

at least one electrical connector connecting said control members to said appliance system;

a bracket assembly mounting said control panel to said housing for movement from a first position to a second position; and a damping assembly connected to said control panel and being adapted to resist movement of said control panel both from said first position to said second position and from said second position to said first position;

a first spring connected to the control panel and biasing the control panel to the second position; and a latch holding the control panel in the first position and being releasable to permit the control panel to move to the second position.

9. A retractable appliance control according to claim 8 wherein said damping assembly comprises a first damping member mounted to said cabinet housing for movement with respect thereto in response to movement of said control panel between said first and second positions.

10. A retractable appliance control according to claim 9 wherein said first damping member is rotatable about a damper axis.

11. A retractable appliance control according to claim 10 wherein a connecting member engages said first damping member and said control panel for transferring motion of said control panel between said first and second positions to said first damping member and causing said first damping member to rotate about said damper axis.

12. A retractable appliance control according to claim 9 and further comprising a spring exerting a biasing force on said first damping member toward said cabinet housing to increase said frictional engagement between said first damping member and said cabinet housing.

13. A retractable appliance control according to claim 12 and further comprising an adjustment mechanism connected to said spring to permit adjustment of said biasing force said spring exerts on said first damping member toward said cabinet housing.

14. A retractable appliance control according to claim 9 wherein a grease material is positioned between said first member and said cabinet housing.

15. A retractable appliance control according to claim 8 wherein said damping assembly comprises an elongated rack and a rotatable gear engaging said rack for meshed rotating engagement along the length thereof during movement of said control panel between said extended and retracted positions.

16. A retractable appliance control according to claim 15 and further comprising a gear holder retentively holding said gear and permitting movement of said gear relative to said rack to prevent said gear from binding while it rotatably engages said rack during extension and retraction of said control panel between said extended and retracted positions.

17. A retractable appliance control comprising in combination:

a cabinet housing having a control receiving recess therein;

a control panel having a panel housing and a plurality of control members on the exterior surface of said panel housing, an appliance system for performing a plurality of functions in said appliance;

at least one electrical connector connecting said control members to said appliance system for controlling said appliance system;

a bracket assembly mounting said control panel within said control receiving recess for movement from a retracted position wherein said control members are substantially contained within said control receiving recess to an extended position wherein said control members are outside said control receiving recess;

a latch mechanism for retentively engaging and holding the control panel in the retracted position; and a spring yieldably urging the control panel from the retracted to the extended position, the latch mechanism being releasable to permit the control panel to move from the retracted to the extended position.

18. A retractable appliance control according to claim 17 and further comprising a damping assembly connected to said control panel for resisting movement of said control panel both from said retracted position to said extended position and from said extended position to said recessed position.

19. A retractable appliance control according to claim 18 wherein said damping assembly comprises a first damping member mounted to said cabinet housing for movement with respect thereto, said first damping member being movable in response to movement of said control panel between said retractable and extended positions.

20. A retractable appliance control according to claim 19 wherein a grease material is located between said first damping member and said cabinet housing.

21. A retractable appliance control according to claim 18 wherein said damping assembly comprises an elongated rack and a rotatable gear engaging said rack for meshed rolling engagement along the length thereof during movement of said control panel between said extended and retracted positions.

22. A retractable appliance control according to claim 21 and further comprising a gear holder retentively holding said gear and permitting movement of said gear relative to said rack to prevent said gear from binding while it rotatably engages said rack during extension and retraction of said control panel between said extended and retracted positions.

23. A retractable appliance control comprising in combination:

a cabinet housing having a control receiving recess therein;

a control panel having a panel housing and a plurality of control members on the exterior surface of said panel housing, an appliance system for performing a plurality of functions in said appliance;

at least one electrical connector connecting said control members to said appliance system for controlling said appliance system;

a bracket assembly mounting said control panel within said control receiving recess for movement from a retracted position wherein said control members are substantially contained within said control receiving recess to an extended position wherein said control members are outside said control receiving recess; and the bracket assembly permitting movement of the control panel along a straight line axis between the retracted and the extended position.

* * * * *